US009719637B2

(12) United States Patent
Boonekamp et al.

(10) Patent No.: US 9,719,637 B2
(45) Date of Patent: Aug. 1, 2017

(54) TUBULAR LIGHTING DEVICE

(71) Applicant: KONINKLIJKE PHILIPS N.V., Eindhoven (NL)

(72) Inventors: Erik Paul Boonekamp, Utrecht (NL); Martinus Hermanus Wilhelmus Maria Van Delden, Venlo (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/895,069

(22) PCT Filed: May 23, 2014

(86) PCT No.: PCT/EP2014/060597
§ 371 (c)(1),
(2) Date: Dec. 1, 2015

(87) PCT Pub. No.: WO2014/195144
PCT Pub. Date: Dec. 11, 2014

(65) Prior Publication Data

US 2016/0109068 A1 Apr. 21, 2016

(30) Foreign Application Priority Data

Jun. 3, 2013 (EP) ..... 13170206

(51) Int. Cl.
*F21K 99/00* (2016.01)
*F21V 3/04* (2006.01)
(Continued)

(52) U.S. Cl.
CPC ..... *F21K 9/17* (2013.01); *F21K 9/27* (2016.08); *F21S 4/28* (2016.01); *F21V 3/04* (2013.01);
(Continued)

(58) Field of Classification Search
CPC ... F21K 9/17; F21K 9/27; F21V 29/70; F21V 3/04; F21V 5/04; F21V 5/043; F21S 4/28;
(Continued)

(56) References Cited

U.S. PATENT DOCUMENTS 6,361,186 B1 * 3/2002 Slayden ..... F21V 3/02 362/219
2009/0290334 A1 11/2009 Ivey et al.
(Continued)

FOREIGN PATENT DOCUMENTS

WO 2011132120 A1 10/2011
WO 2012063174 A2 5/2012

*Primary Examiner* — Laura Tso

(57) ABSTRACT

A tubular lighting device comprising an elongated heat sink (3), at least one light source (5) mounted on the elongated heat sink (3), and an elongated hollow tubular member (7) with a first and a second end arranged along the elongated heat sink (3). The tubular member (7) comprises a lens (15) and a light exit surface (9). The light exit surface is located in front of the lens (15) and the light exit surface (9) have at least one diffusing portion (11) with a transparent portion on each side of each diffusing portion. The at least one diffusing portion (11) covers an area on the light exit surface (9) corresponding to a light distribution of said lens (15) projected on the light exit surface (9), such that all light is directed by said lens (15) onto the at least one diffusing portion (11).

15 Claims, 4 Drawing Sheets

(51) Int. Cl.

| | |
|---|---|
| ***F21V 5/04*** | (2006.01) |
| ***F21V 29/70*** | (2015.01) |
| ***F21S 4/28*** | (2016.01) |
| ***F21K 9/27*** | (2016.01) |
| *F21Y 103/10* | (2016.01) |
| *F21Y 115/10* | (2016.01) |

(52) U.S. Cl.
CPC ..... *F21V 5/04* (2013.01); *F21V 5/043* (2013.01); *F21V 29/70* (2015.01); *F21Y 2103/10* (2016.08); *F21Y 2115/10* (2016.08)

(58) Field of Classification Search
CPC ..... F21Y 2103/10; F21Y 2115/10; F21Y 2101/00
USPC ..... 362/218, 219, 222, 223, 225
See application file for complete search history.

(56) References Cited

U.S. PATENT DOCUMENTS

| | | | | |
|---|---|---|---|---|
| 2010/0157608 | A1 | 6/2010 | Chen et al. | |
| 2010/0214764 | A1* | 8/2010 | Chaves ..... | G02B 6/0096 362/84 |
| 2011/0292652 | A1 | 12/2011 | Huang et al. | |
| 2011/0305024 | A1 | 12/2011 | Chang | |
| 2012/0106144 | A1 | 5/2012 | Chang | |

* cited by examiner

TUBULAR LIGHTING DEVICE

CROSS-REFERENCE TO PRIOR APPLICATIONS

This application is the U.S. National Phase application under 35 U.S.C. §371 of International Application No. PCT/EP2014/060597, filed on May 23, 2014, which claims the benefit of European Patent Application No. 13170206.0, filed on Jun. 3, 2013. These applications are hereby incorporated by reference herein.

FIELD OF THE INVENTION

The present invention generally relates to a tubular lighting device, and more specifically to a tubular lighting device with improved illumination features for retrofit fluorescent lamp fixtures.

BACKGROUND OF THE INVENTION

Today, the interest in developing and improving alternative lighting devices has greatly increased due to the removal of incandescent light bulbs on the market. This has further lead to increased demands on reduced production costs and to increase the performance of the alternative lighting devices. For example, lighting devices with light emitting diodes have several advantages compared to other conventional lighting, including for example high energy efficiency, high light output and long service life. Therefore, light emitting devices have also started to be incorporated into tubular lighting devices, replacing the traditional fluorescent tubes commonly found in offices, and other general places.

However, the use of light emitting diodes in general lighting is generally associated with problem relating to unsatisfactory illumination distribution, such as uneven light distribution, glaring light and spottiness. Persons exposed to this type of lighting may be affected negatively by for example being forced to peer or otherwise risk eye strain to compensate for the unsatisfactory illumination.

In US2012/0106144, a LED tube lamp is disclosed having an optical arrangement of lenses arranged to spread light from light emitting diodes to a cover in order to achieve a more uniform light output distribution.

However, it would be advantageous to provide a lighting device with an improved illumination distribution to fulfill the requirements of light output intensity and distribution in an alternative manner.

Hence, there is a further need for a lighting device adapted to be arranged in fluorescent lighting fixtures and luminaires to provide improved illumination distribution. Additionally, there is a further need for a lighting device for improved illumination distribution able to be provided by cost efficient components.

SUMMARY OF THE INVENTION

It is an object of the present invention to provide an improved tubular lighting device in order to at least partly overcome above mentioned problems.

This and other objects are achieved by a tubular lighting device comprising an elongated heat sink; at least one light source mounted on the elongated heat sink; and an elongated hollow tubular member with a first and a second end arranged along the elongated heat sink, said tubular member comprising a lens extending between the first and the second end of the tubular member with a light entry surface facing said at least one light source, said lens being adapted to direct light emitted from the at least one light source; and a light exit surface extending between the first and the second end, the light exit surface being located in front of said lens in a light output direction and the light exit surface having at least one diffusing portion with a transparent portion on each side of each diffusing portion, wherein the at least one diffusing portion covers an area on the light exit surface corresponding to a light distribution of said lens projected on the light exit surface, such that the majority of the light emitted by said at least one light source is directed by said lens onto said at least one diffusing portion. Preferably, all light emitted by said at least one light source is directed by said lens onto said at least one diffusing portion, but due to the light distribution of the emitted light a some light may still be directed to the transparent portion.

According to this aspect of the invention, light emitted by the light source(s) will be directed to the diffusing portion(s) of the light exit surface, and thus be scattered at least once before exiting the tubular lighting device. Of course, light may be scattered multiple times by the at least one diffusing portion before being transmitted through either the diffusing portion(s) or the transparent portions out to the surroundings.

As all light is scattered at least once by the at least one diffusing portion, a more uniform light distribution will be emitted from the tubular lighting device. In effect, the hollow tubular member will act as a light mixing chamber for light provided by the light source(s) which is advantageous for providing a uniform light output. The diffuse part of the tube receives mainly direct light from the LEDs; the clear part of the tube receives mainly indirect light from the diffuse part of the tube.

The term "transparent portion" should in the context of this invention be interpreted broadly, indicating a portion which allows transmission of light without scattering. For instance, the transparent portions may be clear or colored.

The light exit surface may have one diffusing portion or a plurality of diffusing portions, wherein each diffusing portion have a transparent portion on either side. The number of transparent portions corresponds to the number of diffusing portions increased by one for each tubular lighting device. Thus, a tubular lighting device with one diffusing portion has two transparent portions and a device with two diffusing portions has three transparent portions etc.

The light distribution may be tuned by adjusting the shape of the light exit surface, the distance between the lens and the light exit surface, the scattering properties of the diffusing portion(s), i.e. the transmittance along the diffusing portion(s) in a transverse direction and in the direction between the first end and the second end. The intensity of the emitted light may be greatest in proximity at a centre of a direction of emission, and may diminish with an increasing angle from this centre of emission. Therefore, it may be advantageous that the transmittance of the diffusing portion(s) is lowest in an area of the tubular member with the greatest intensity, at a centre of each diffusing portion(s), and increases with increasing angles from this point on each side of each at least one diffusing portion. The transmittance may gradually increase with an increasing angle along the light exit surface until the diffusing portion(s) is transformed into the transparent portion. However, other variations are also possible. The transmittance may for example be changed in defined steps. Of course, the transmittance of the diffusing portion(s) may also vary in the axial direction of the tubular member, i.e. in a direction along the tubular member between the first and the second end, and e.g. be lower in proximity to a light source (where light is stronger), and greater at a point between two light sources (where light is weaker).

According to an embodiment, the at least one diffusing portion may be located assymmetrically opposite said lens. For certain applications it may be advantageous to locate the diffusing portion assymmetrically, when the illumination may preferably be directed in particular direction or to achieve a desired scattering event. In the case of more than one diffusing portion, some of the diffusing portion may be located assymmetrically opposite said lens.

According to one embodiment, the at least one diffusing portion may be limited to cover the area on the light exit surface corresponding to the light distribution of the lens projected on the light exit surface. By limiting the diffusing portion(s) after each output light distribution of the lens, the distance between the lens and the shape of light exit surface may be more easily determined such that a desired light distribution is achieved.

According to one embodiment, the at least one diffusing portion may cover less than half the light exit surface. An advantage is that the ratio between the diffusing portion(s) and the transparent portions may improve the light mixing properties of the light mixing chamber for the tubular lighting device and when arranged in a luminaire.

According to an embodiment, the elongated hollow tubular member may have a plurality of diffusing portions and wherein the light distribution of the lens may be discontinuous so that light is directed towards the plurality of diffusing portions. Each of the diffusing portions may be separated by a transparent portion, and for cases with two or more diffusing portions it may be advantageous to have a lens able to direct light towards different diffusing portions of the light exit surface to achieve improved light mixing. In some cases the the tubular lighting device has multiple diffusing portions, the light distribution emitted by the lens may therefore be discontinuous to be able to direct light to one, some or all of the diffusing portion(s).

The number of diffusing portion may be, but is not restricted to, one diffusing portion. The advantage with having only one diffusing portion is that the demands of the accuracy and quality of the components are decreased, especially for the lens, since the light distribution does not have any disruptions. The elongated hollow tubular member may have one diffusing portion located essentially opposite the lens. In particular, when light is emitted in a direction perpendicular to a surface of the light sources by the lens, it is advantageous that the diffusing portion is located essentially opposite the lens. The diffusing portion may also be, but is not restricted to, a symmetric arrangement of the diffusing portion opposite the lens.

The light source(s) may be, but is not restricted to, light emitting diode(s). Light emitting diodes have several advantageous properties such as high energy efficiency, high light output and long service life. The light source may also include an optical component configured to shape the emitted light, such as a collimator, multi-collimator, reflector, lens, etc.

The elongated hollow tubular member may have an essentially circular cross-section, with an indentation for forming a shape of the lens. Such a cross-section may be advantageous for achieving a uniform light emission in all directions. However, other shapes of the cross-section may also be conceivable, and the expression "tubular" is here intended to cover also other cross-sections, such as essentially elliptical, or a triangle, quadrangle, or another essentially polygonal shape.

The elongated hollow tubular member and/or the elongated heat sink may be manufactured by means of extrusion. This may provide cost efficient production, especially in a case where the tubular member has a constant cross-section. Furthermore, an additional advantage is that the diffusing portion(s) may be added simultaneously through coextrusion, which may allow a subsequent production step to be avoided.

The lens may be a cylindrical lens, essentially only directing light in a plane normal to the longitudinal axis of the tubular member. Examples of such lenses include plano-convex lenses and plano-concave lenses.

The tubular lighting device may be adapted to be installed in a luminaire for fluorescent tubes. Such so-called retrofit light tubes avoid the need to replace conventional lighting fixtures, saving cost and resources.

According to one embodiment, the tubular lighting device has the shape of a straight cylinder. Such shape is convenient for use with conventional lighting fixtures. However, the tubular member (and thus the entire tubular lighting device) may alternatively be curved. The shape of the tubular lighting device may for example be a circle, ellipse or a U-shaped tubular lighting device. In particular, the shape of a tubular lighting device may resemble a torus.

According to one embodiment, the lens may be in near proximity to the at least one light source. An advantage with a lens arranged in near proximity, for example in abutment, to the at least one light source more of the light emitted by the at least one light source is refracted by the lens, i.e. the lighting device will increase its efficiency. If the lens is placed away from the light source, some produced light may be wasted or enter the the light hollow tubular member in an unsuitable angle.

According to one embodiment, the lens may have a total light distribution angle of less than 90°. By limiting the angular spread of the lens, the ratio between the diffusing portion(s) and the transparant portions may be improved, resulting in a desired light output distribution.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The aspect of the invention, including its particular features and advantages, will be readily understood from the following detailed description and the accompanying drawings, in which.

DETAILED DESCRIPTION

Figure 1:
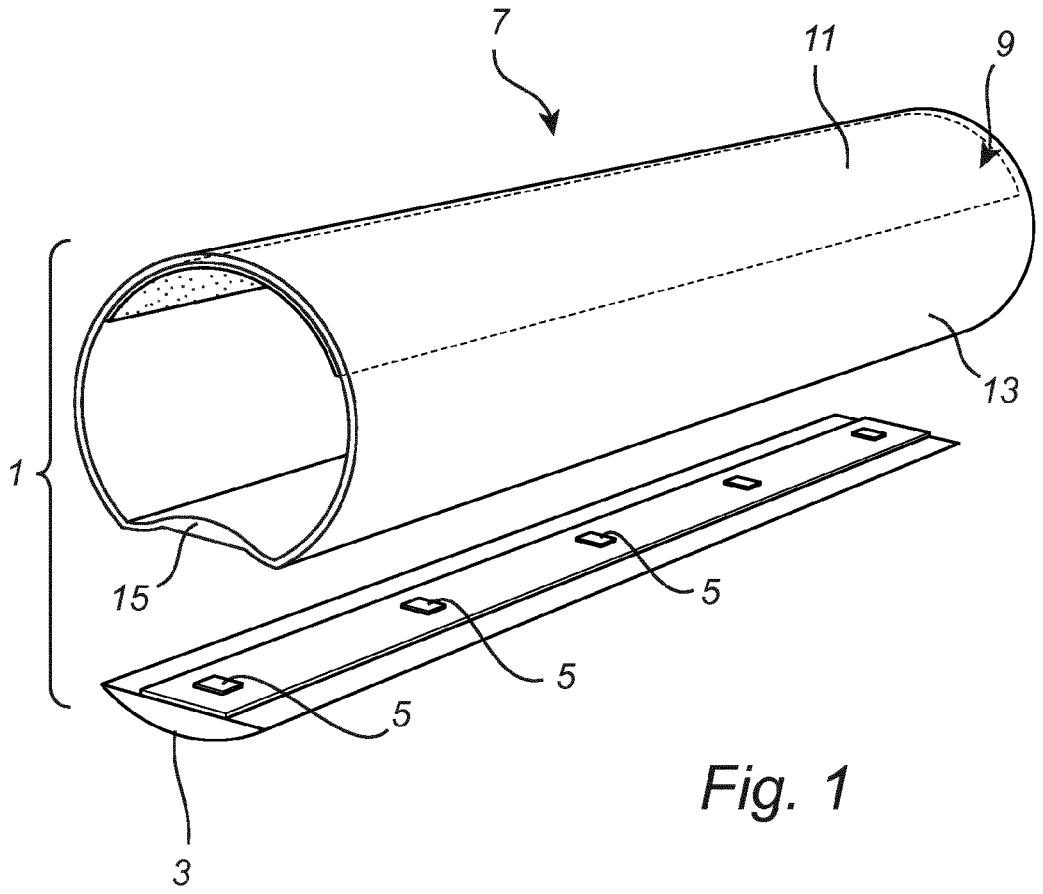
FIG. 1 illustrates an exploded perspective view of the tubular lighting device according to an example embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference characters refer to like elements throughout.

Referring now to the drawings and to FIG. 1 in particular, there is depicted an exploded perspective view of the tubular lighting device 1 comprising a heat sink 3 and a hollow tubular member 7. As is illustrated in FIG. 1, at least one light emitting diode 5, here five light emitting diodes are mounted with a PCB on the heat sink 3. The periphery of the hollow tubular member 7 includes an elongated lens 15 and a light exit surface 9. The light exit surface 9 and the elongated lens 15 here extend between a first end and a second end of the tubular member 7.

As is illustrated in FIG. 1, the hollow tubular member 7 is arranged along the elongated heat sink 3. The cross-section of the heat sink may, in a transverse direction of the elongated heat sink, be approximately a segment of a circle as is illustrated in FIG. 1 with the flat surface arranged towards the hollow tubular member. The heat sink 3 is arranged to dissipate heat in the opposite direction of the light output direction of the light emitting diode(s), i.e. away from the tubular member and downwards in FIG. 1. The heat sink 3 may be made of a metal substrate PCB. The use of the heat sink 3 with a substrate PCB for a heat transferring arrangement enables the light emitting diode(s) to be configured directly on the PCB. The heat sink 3 may, further, include a metal material with satisfactory heat conductive characteristics and rigidness, in order to be able to avoid thermal bending. The heat sink may be made of, for example, aluminum or steel. However, other material may also be conceivable, such as a ceramic material (e.g. based on aluminum oxide). Furthermore, the heat sink 3 may in some embodiments be provided with a groove along the elongated heat sink 3 to allow the light sources to be embedded in the heat sink. The heat sink 3 may be produced by means of extrusion.

Figure 2:
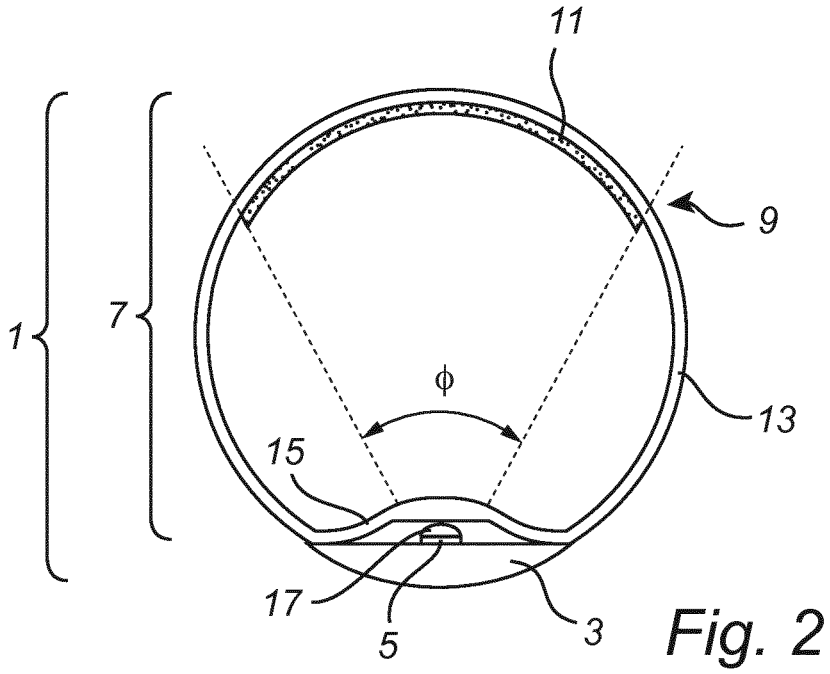
FIG. 2 shows a cross-sectional view of the tubular lighting device according to an example embodiment.

With reference to FIG. 2, the elongated hollow tubular 7 in this embodiment has substantially the shape of a circular cylinder, which is preferable when arranged in conventional fixtures 19 for fluorescent tubes. The cylinder has an indentation for receiving the elongated lens 15.

As indicated in FIG. 2, the elongated lens 15 is arranged to spread light emitted by the light emitting diodes by an angle of spread, $\phi$, in a plane perpendicular against the longitudinal extension of the tubular member. The angle of spread may correspond to the light distribution of the lens. The lens may also be arranged to spread light from the diodes in a tangential plane parallel to the longitudinal extension of the tubular member. However, in the example in FIG. 1, the lens is a linear cylindrical lens, i.e. is adapted to spread light only in the tangential plane. However, other lenses may also be suitable such as a plano-concave lens or a CPC (Compound Parabolic Concentrator). The lens may be made of plastic or glass, such as polymethyl methacrylate, PMMA. More particularly, the lens in FIG. 1 is a plano-convex cylindrical lens with the shape of a segment of a circle. The flat side of the convex cylindrical lens is arranged closest to the light emitting diodes.

Further with reference with FIG. 2, the light exit surface is divided in a diffusing portion 11 extending approximately opposite the elongated lens 15, and two transparent portions 13 extending on each side of the tubular member between the diffusing portion 11 the elongated lens 15.

The diffusing portion has an extension at least corresponding to a projection of the light distribution of the elongated lens 15, to ensure that all or at least the majority of the light emitted by the diodes will be directed to the diffusing portion. In some embodiments the diffusing portion 11 may cover a larger surface of the light exit surface 9 than the surface illuminated by the emitted light.

Referring now to FIG. 2, there is depicted a cross-sectional view of the tubular lighting device 1. As is illustrated in FIG. 2, the cross-section across the tubular lighting device 7 is a circular cross-section, which may advantageously be arranged for conventional light fixtures for fluorescent tubes. Furthermore, in the illustrated embodiment of FIG. 2, the light emitting diode 5 is, as described above, mounted on the heat sink 3. The heat generated by the light emitting diode(s) when emitting light is dissipated in the opposite direction compared to the direction of the light of the light emitting diode 5. The elongated lens 15 is arranged in near proximity to the light emitting diode 5. The light emitting diode 5 may include integrated optical elements, such as a lens 17 to further guide the light. As illustrated in FIG. 2 the surface of the light exit surface illuminated by the light refracted by the lens 15 correspond to the surface of the light exit surface 9 covered by the diffusing portion 11. The diffusing portion 11 has a layer with diffusing material applied on an inner side of the hollow tubular member 7. The angular range of the light outputted by the elongated lens 15, i.e. the light distribution, is the angle of spread, $\phi$.

The diffusing portion 11 may include a layer of diffusive material applied either an inner or an outer side of the hollow tubular member. The diffusing portion 11 may in some embodiments also be integrated, such that a diffusive material is mixed with the material of the hollow tubular member that is limited to the diffusing portion 11. As is illustrated in FIG. 1, the diffusing portion 11 includes an added layer on an inner side of the hollow tubular member 7.

The diffusing portion 11 may comprise scattering particles, such as high scattering non-absorbing particles, such as for example $TiO_2$, $Al_2O_3$ or $SiO_2$. The transmittance is determined by the amount of light being transmitted through a material compared to the amount of incoming light. The amount of scattering particles may determine the amount of light being transmitted and how much light is reflected back. Increasing amounts of scatterers may decrease the transmittance. The diffusing portion may be integrated in a sheet, or be added in several layers allowing diffusivity. The diffusing portion may be arranged with a sine profile.

The diffusing portion may further comprise a wavelength converting layer, which is advantageous for providing a smooth light output, or a desired wavelength of light from the tubular lighting device. Wavelength conversion layers may also be integrated in a sheet, or added as a separated sheet or several sheets allowing for graded light conversion.

The thickness of the diffusing portion 11 may determine the transmittance and may influence the output distribution of the light exit surface 9, increasing thickness of the diffusing portion 11 results in decreased transmittance. The light refracted by the lens 15 may be scattered multiple times before exiting the light exit surface 9 either from the diffusing portion 11 or the transparent portions 13 in order to ensure a uniform distribution.

The elongated hollow tubular member 7 may be produced by means of extrusion or co-extrusion. The wording "coextrusion" should in the following be interpreted as the extrusion of multiple layers of material simultaneously. The thickness of the layers may be controlled by the speed and size of the means providing the material. The transmittance, may thus be regulated by the thickness of the diffusing portion applied by the means of coextrusion. A die, used during extrusion to shape the elongated hollow tubular member may have a outer shape of a circle, triangle, ellipse, quadrangle etc. The die may further be arranged with an inner shape corresponding to the outer shape to provide a hollow tubular member. Furthermore, the die may comprise a lens shape such that an elongated lens is extending from the first end to the second end of the hollow tubular member having a constant cross-section. The elongated hollow tubular member may comprise polymer material, e.g. polymethyl methacrylate, PMMA, or PC-poly carbonate. Alternatively, the hollow tubular member may be made of glass.

Figure 3:
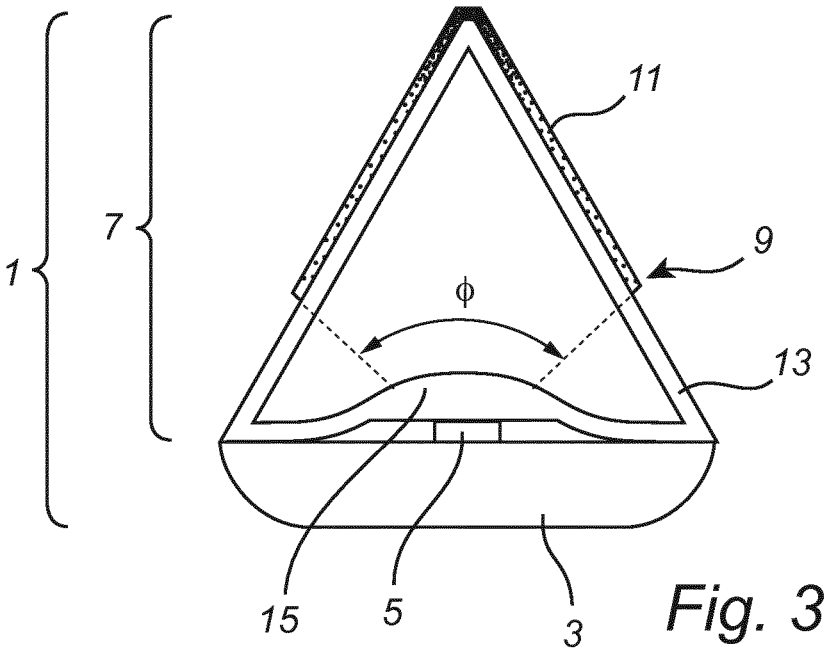
FIG. 3 illustrates another embodiment of the cross-sectional view of the tubular lighting device, with a triangular cross-section, according an example embodiment of the present invention.

Reference is now made to FIG. 3, depicting a cross-section view of a tubular lighting device 1 as described in FIG. 1 and FIG. 2, but in this case with a substantially triangular cross-section according to an embodiment of the invention. The heat sink 3 is configured as described in reference to FIG. 1. The light emitting diode 5 is mounted on the heat sink 3. The hollow tubular member 7, here with a substantially triangular cross-section, is attached to the heat sink 3. The elongated lens 15 allows light to be refracted and enables light to enter the hollow tubular member 7 arranged as a mixing chamber with a diffusing portion 11 and two transparent portions 13 arranged on each side of the diffusing portion 11. The light is firstly directed to the diffusing portion 11 of the light exit surface 9 in order to be scattered at least once before being transmitted out of the light exit surface 9 to the surroundings. The transmittance of the diffusing portion 11 may be varied over the along the cross-section. As is illustrated in FIG. 3, the diffusing portion 11 is arranged with a layer with diffusing material on the outward side of the light exit surface. The amount of scatterers is increased in proximity to the center of light distribution defined by the lens 15. Alternatively, the thickness may be increased at the center light distribution. Thus, the thickness or the concentration of scatters may be varied across the diffusing portion 11 in order to influence the transmittance to achieve an improved illumination distribution.

Figure 4:
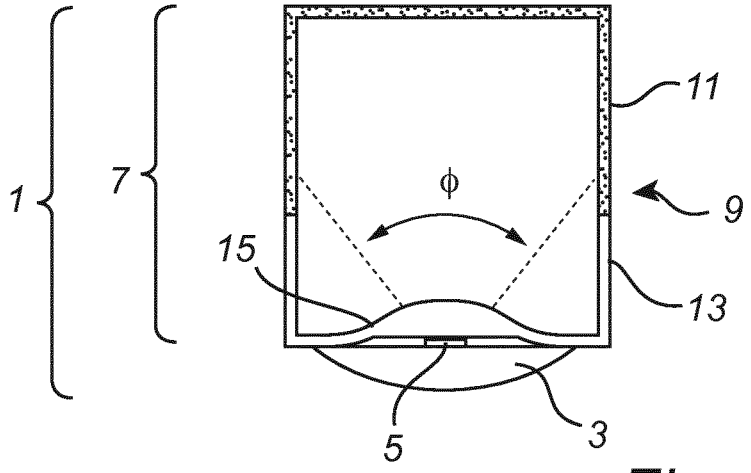
FIG. 4 illustrates a cross-sectional view of the tubular lighting device having a regular quadrilateral cross-section according to an embodiment of the invention.

Reference is now made to FIG. 4, depicting a tubular lighting device 1 as described in FIG. 1-3, but in this case having a substantially four-sided cross-section, here a rectangular cross-section with a diffusing portion 11 covering a surface larger than the surface on the light exit surface 9 defined by the light distribution.

Figure 5:
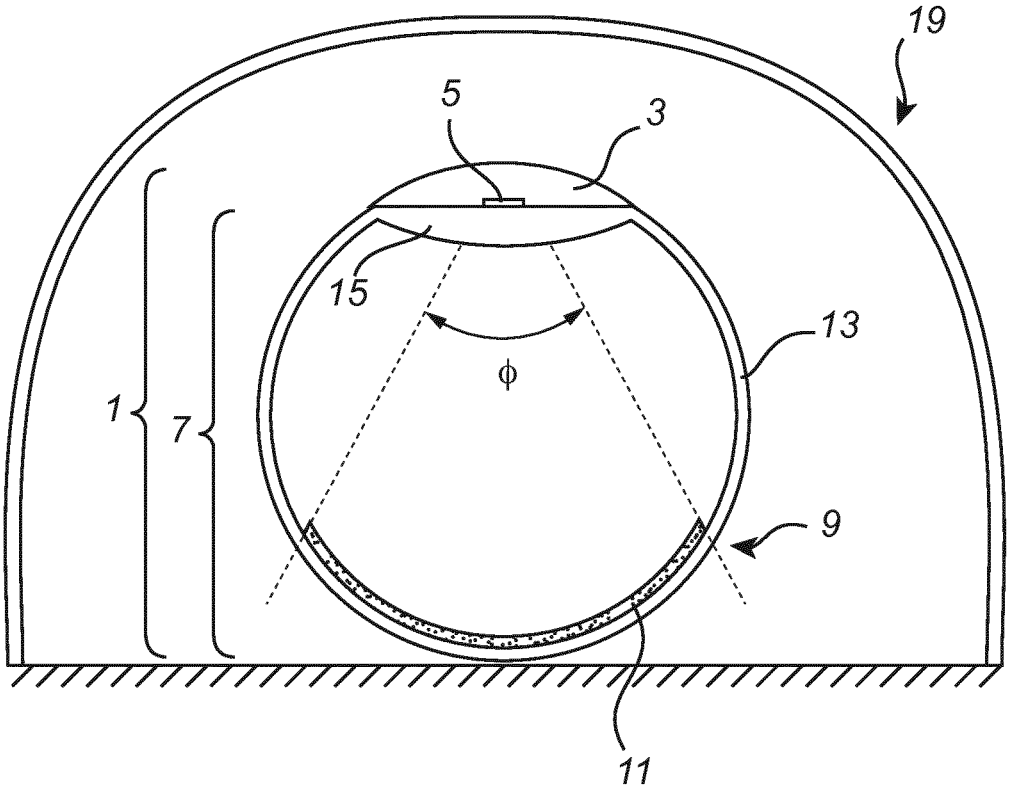
FIG. 5 illustrates, from a perspective view, a tubular lighting device according to an embodiment of the invention is arranged in a luminaire.

Reference is now made to FIG. 5, depicting a luminaire, configured for conventional fluorescent tubes, with a tubular lighting device 1 as described in FIG. 1 inserted into the luminaire 19 to further improve the illumination. The tubular lighting device 1, described in reference to FIG. 1, may particularly be advantageous for retrofit fluorescent tube lighting fixtures or luminaires. As is illustrated in FIG. 5, heat sink is arranged with a groove on a flat side along the elongated heat sink to allow the light sources to be attached and be embedded in the heat sink. A typical length of straight cylindrical tubular device, which is adapted for many conventional lighting fixtures for fluroescent tubes, is 1.2 m. Furthermore, the properties of light mixing chamber may be affected by the ratio between the diffusing portion and the two transparent portions. Therefore, the tubular lighting device 1 may be suitable for many different types of luminaires having a variety of reflectors, shades etc.

Figure 6:
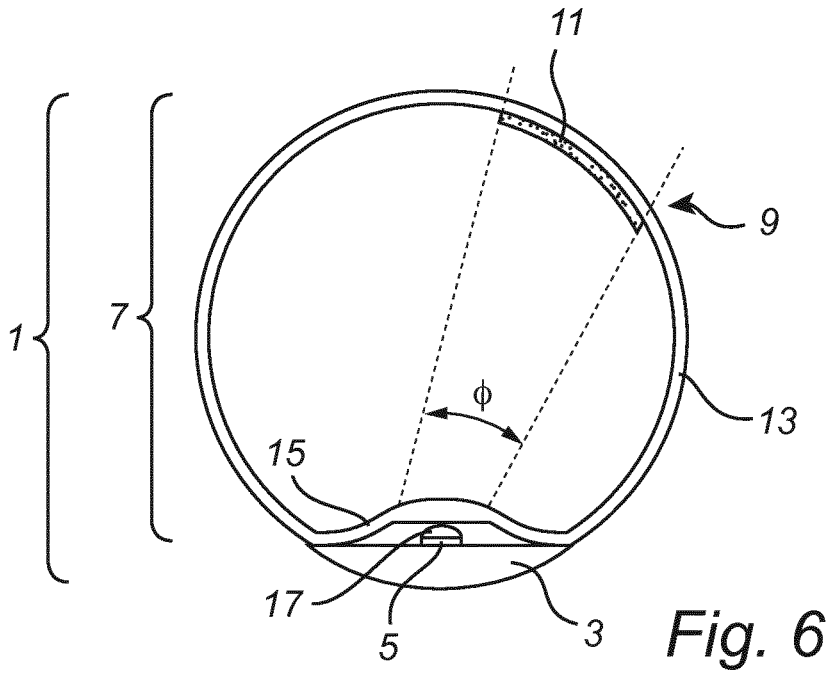
FIG. 6 illustrates a cross-sectional view of a tubular lighting device having an asymmetrical diffusing portion.

Reference is now made to FIG. 6, depicting a cross-section view of a tubular lighting device 1 as described in FIG. 2 with a difference in the position of the diffusing portion 11. The diffusing portion 11 may be arranged asymmetrically on the light exit surface, such that one of the transparent portions between the diffusing portion 11 and the lens 15 covers a greater surface than the other transparent portion 13, as illustrated in FIG. 2. For embodiments with an asymmetrically located diffusing portion 11, a lens able to provide an asymmetric light distribution may be used. The lens shape may have an asymmetric cross-section in a transverse direction of the tubular member in order to be able to refract the light asymmetrically.

Figure 7:
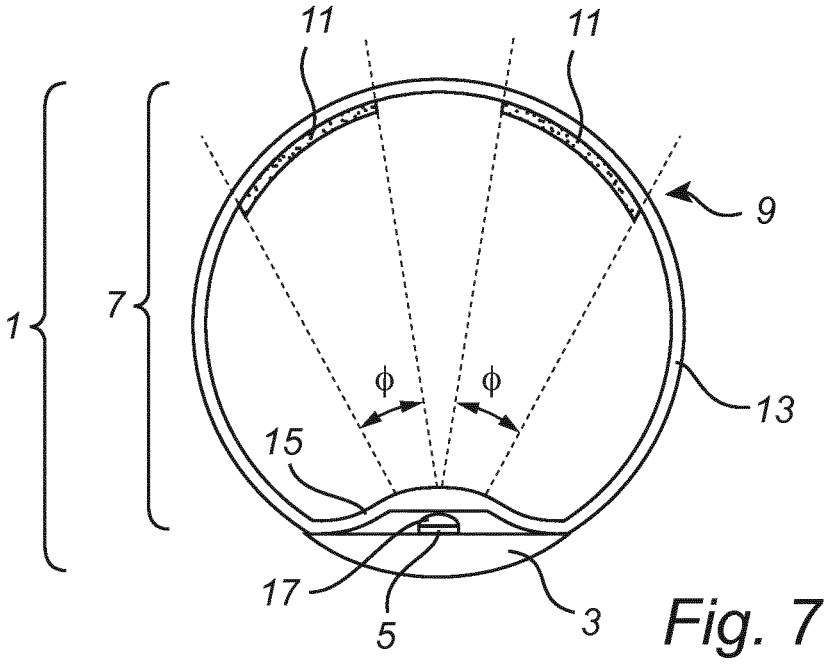
FIG. 7 illustrates a cross-sectional view of a tubular lighting device having a plurality of diffusing portions.

Reference is now made to FIG. 7, depicting a cross-section view of a tubular lighting device as described in FIG. 2 with a plurality of diffusing portions 11 and transparent portions 13. In previous figures embodiments a tubular lighting device 1 has been disclosed with only one diffusing portion. However, each of these disclosed embodiments may be adapted for a plurality of diffusing portions 11. In FIG. 7 the disclosed tubular lighting device has a light exit surface 9 with two diffusing portions 11. Each of the two diffusing portions 11 are located asymmetrically compared to the opposite lens 15. For some embodiments the lens may be configured to only illuminate one, some, or all of the diffusing portions. As illustrated in FIG. 7 the lens 15 may provide a discontinuous light distribution with a disruption for every direction aimed towards the transparent portions. The lens shape may vary depending on the number of diffusing portions and their location on the light exit surface. In FIG. 7 the light source(s) comprises an optical component such as a lens to further facilitate a discontinuous light distribution so the light from the lens 15 is divided in two sections directed to the diffusing portions. It may also be feasible to provide opaque portions on the lens to prevent that light from the light source(s) is directed to the transparent portions.

Even though the invention has been described with reference to specific embodiments thereof, many different alterations, modifications and the like will become apparent for those skilled in the art. Parts of the system may be omitted, interchanged or arranged in various ways, the system may yet being able to perform the method of the present invention.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The invention claimed is:

1. A tubular lighting device comprising:

an elongated heat sink;

at least one light source mounted on the elongated heat sink, and an elongated hollow tubular member with a first and a second end arranged along the elongated heat sink, said tubular member comprising a lens extending between the first and the second end of the tubular member with a light entry surface facing said at least one light source, said lens being adapted to direct light emitted from the at least one light source; and a light exit surface extending between the first and the second end, the light exit surface being located in front of said lens in a light output direction and the light exit surface having at least one diffusing portion with a transparent portion on each side of each diffusing portion, and wherein the at least one diffusing portion covers an area on the light exit surface corresponding to a light distribution of said lens projected on the light exit surface, such that the majority of the light emitted by said at least one light source is directed by said lens onto said at least one diffusing portion, and wherein at least a portion of the light emitted by said at least one light source is directed by said lens onto said transparent portions on each side of each diffusing portion.

2. A tubular lighting device comprising:

an elongated heat sink;

at least one light source mounted on the elongated heat sink, and an elongated hollow tubular member with a first and a second end arranged along the elongated heat sink, said tubular member comprising a lens extending between the first and the second end of the tubular member with a light entry surface facing said at least one light source, said lens being adapted to direct light emitted from the at least one light source; and a light exit surface extending between the first and the second end, the light exit surface being located in front of said lens in a light output direction and the light exit surface having at least one diffusing portion with a transparent portion on each side of each diffusing portion, and wherein the at least one diffusing portion covers an area on the light exit surface corresponding to a light distribution of said lens projected on the light exit surface, such that the majority of the light emitted by said at least one light source is directed by said lens onto said at least one diffusing portion, and wherein the at least one diffusing portion has a transmittance which varies along a cross-section of said tubular member.

3. A tubular lighting device comprising:

an elongated heat sink;

at least one light source mounted on the elongated heat sink, and an elongated hollow tubular member with a first and a second end arranged along the elongated heat sink, said tubular member comprising a lens extending between the first and the second end of the tubular member with a light entry surface facing said at least one light source, said lens being adapted to direct light emitted from the at least one light source; and a light exit surface extending between the first and the second end, the light exit surface being located in front of said lens in a light output direction and the light exit surface having at least one diffusing portion with a transparent portion on each side of each diffusing portion, and wherein the at least one diffusing portion covers an area on the light exit surface corresponding to a light distribution of said lens projected on the light exit surface, such that the majority of the light emitted by said at least one light source is directed by said lens onto said at least one diffusing portion, and wherein the at least one diffusing portion is located asymmetrically opposite said lens.

4. The tubular lighting device according to claim 1, wherein the at least one diffusing portion is limited to cover the area on the light exit surface corresponding to the light distribution of said lens projected on the light exit surface.

5. A tubular lighting device comprising:

an elongated heat sink;

at least one light source mounted on the elongated heat sink, and an elongated hollow tubular member with a first and a second end arranged along the elongated heat sink, said tubular member comprising a lens extending between the first and the second end of the tubular member with a light entry surface facing said at least one light source, said lens being adapted to direct light emitted from the at least one light source; and a light exit surface extending between the first and the second end, the light exit surface being located in front of said lens in a light output direction and the light exit surface having at least one diffusing portion with a transparent portion on each side of each diffusing portion, and wherein the at least one diffusing portion (covers an area on the light exit surface corresponding to a light distribution of said lens projected on the light exit surface, such that the majority of the light emitted by said at least one light source is directed by said lens onto said at least one diffusing portion, and wherein the at least one diffusing portion covers less than half the light exit surface.

6. A tubular lighting device comprising:

an elongated heat sink;

at least one light source mounted on the elongated heat sink, and an elongated hollow tubular member with a first and a second end arranged along the elongated heat sink, said tubular member comprising a lens extending between the first and the second end of the tubular member with a light entry surface facing said at least one light source, said lens being adapted to direct light emitted from the at least one light source; and a light exit surface extending between the first and the second end, the light exit surface being located in front of said lens in a light output direction and the light exit surface having at least one diffusing portion with a transparent portion on each side of each diffusing portion, and wherein the at least one diffusing portion covers an area on the light exit surface corresponding to a light distribution of said lens projected on the light exit surface, such that the majority of the light emitted by said at least one light source is directed by said lens onto said at least one diffusing portion, and wherein the elongated hollow tubular member has a plurality of diffusing portions and wherein the light distribution of said lens is discontinuous so that light is directed towards the plurality of diffusing portions.

7. The tubular lighting device according to claim 1, wherein the elongated hollow tubular member has one diffusing portion located essentially opposite said lens.

8. The tubular lighting device according to claim 1, wherein the tubular lighting device has an essentially circular cross-section in a transverse direction of the tubular lighting device.

9. The tubular lighting device according to claim 1, wherein the lens is a cylindrical lens, having a constant cross-section in a plane normal to a longitudinal direction.

10. The tubular lighting device according to claim 1, wherein at least one of the elongated hollow tubular member and the elongated heat sink has been manufactured by extrusion.

11. The tubular lighting device according to claim 1, wherein the tubular lighting device is adapted to be installed in a luminaire for fluorescent tubes.

12. The tubular lighting device according to claim 1, wherein the light source is a light emitting diode.

13. The tubular lighting device according to claim 1, wherein the tubular lighting device is a straight cylindrical tubular lighting device.

14. The tubular lighting device according to claim 1, wherein the lens is in near proximity to the at least one light source.

15. The tubular lighting device according to claim 1, wherein the lens has a light distribution angle of less than 90°.

* * * * *